United States Patent [19]

Sternberg

[11] Patent Number: 4,933,920

[45] Date of Patent: Jun. 12, 1990

[54] SIDEREAL CLOCK

[76] Inventor: Irwin Sternberg, 56-47 195th St., Flushing, N.Y. 11365

[21] Appl. No.: 286,095

[22] Filed: Dec. 19, 1988

[51] Int. Cl.[5] ..... G04B 19/26

[52] U.S. Cl. ..... 368/15; 368/155; 368/184; 368/200

[58] Field of Search ..... 368/15-20, 368/47, 184, 155-157, 200

[56] References Cited

U.S. PATENT DOCUMENTS

| | | | |
|---|---|---|---|
| 4,487,511 | 12/1984 | Lucarelli | 368/15 |
| 4,582,434 | 4/1986 | Plangger et al. | 368/47 |
| 4,731,767 | 3/1988 | Uehara | 368/15 |

*Primary Examiner*—Bernard Roskoski

[57] ABSTRACT

The sidereal clock comprises a digital clock portion having a 60-Hz pulse source operating at line frequency of 60-Hz. It contains a means for periodically changing logic state at the 50/60-Hz select input of the prescale counter so that the digital clock portion is periodically changed during a period equal to 2922 clock pulses from the 60 Hz operation mode to the 50 Hz operation mode for a time interval equal to 40 clock pulses. During this time interval the prescale counter actually registers 6 counts for every 5 pulses received so that the digital clock portion runs fast by a factor of 2930/2922 and measures sidereal time. The means for changing logic state at the 50/60-Hz select input may comprise a ripple counter connected electrically to a plurality of gating circuits of first and second gating integrated circuits and a monostable multivibrator all of which are energized by the DC of the digital clock portion.

9 Claims, 2 Drawing Sheets

SIDEREAL CLOCK

The Field of The Invention

The instant invention relates to a digital clock and, more particularly, to a digital clock which tells sidereal time.

The Background of the Invention

Measurement of sidereal time, i.e. the time measured by the rotation of the earth relative to the stars rather than the sun, is important for both the astronomer and the navigator. The sidereal day is the time it takes the earth to make a complete rotation relative to the stars, i.e. the time between the same viewing angle of a particular star on successive nights. It differs from the solar day which is indexed to the Sun, and requires that the Sun be on a given meridian at the noon hour every day. Thus the Earth rotates about 361 degrees of arc each solar day to maintain this requirement. The earth rotates through that extra degree in about four minutes which makes the solar day about four minutes longer than a sidereal day. Thus sidereal time runs faster than solar time and in fact, the exact factor is 1.00273791 which may be approximated as the ratio of 2,930/2,922.

As a result of the many advances in integrated circuit technology and the use of light emitting diode displays(LED displays) many inexpensive moderately accurate solar digital clocks costing from $10 are available. These devices function as home alarm clocks, wall clocks and in timers. They are as accurate as the 60 Hz AC line frequency and contain a prescale counter, a connected seconds counter which is connected to a minutes counter and an hours counter. Except for the hours counter these counters are all divide-by-sixty counters. The minutes and hours counters are connected to LED displays which indicate their status and hence the time. This simple arrangement has the advantage that it is not essentially temperature dependent as a digital clock which is driven by a crystal oscillator; thus when the clock running on 60 Hz AC is used or stored in a cold night environment out-of-doors it will register the same time as it would indoors. In some models the prescale counter has a 50/60 Hz Select input which allows for the counter to be internally programmed to divide by 50 or 60. This feature is usually included to allow the clock to be run in parts of Europe where 50 Hz AC line voltage is used rather than 60 Hz AC.

By "digital clock" we mean a clock which runs on 115 volts AC 60 Hz alternating current and displays the time in a digital 24 hour format showing hours and minutes on its face. To be a digital clock which can be modified to make the sidereal clock of the instant invention it must also have a 50/60-hz select input option. It is noted that if the 50 Hz option is utilized where the line frequency is 60 Hz the clock will run fast by a factor of 60/50.

It is a general object of the invention to provide an inexpensive sidereal clock.

It is another object of the invention to provide a sidereal digital clock which will run at the same rate regardless of temperature.

It is an additional object of the invention to provide a means of modifying an inexpensive digital clock operating on 115 volt 60 hz AC which keeps solar time in hours and minutes so that it will keep sidereal time with no accuracy variation due to changing temperature.

SUMMARY OF THE INVENTION

According to the instant invention the sidereal clock comprises a digital clock portion having a 60-Hz pulse source producing a plurality of clock pulses at line frequency(60 hz in the U.S.A.), a prescale counter with a 50/60-Hz select input and a means for periodically changing logic state at the 50/60-Hz select input of the prescale counter so that the digital clock portion is speeded up by a factor of 2930/2922 and runs at the sidereal rate.

The means for periodically changing the logic state at the 50/60-Hz select input may comprise a ripple counter which counts 2922 60 Hz clock pulses during one operational cycle, gating circuits to decode the ripple counter outputs to provide the exact time duration for 50/60 Hz select switching, and a monostable multivibrator to reset the ripple counter at the end of the operational cycle, i.e. 2922 clocks. A first gating integrated circuit is provided including a plurality of gating circuits connected to the ripple counter electrically and a second gating integrated circuit including another plurality of gating circuits. All integrated circuits receive direct current energizing voltage from the digital clock portion. The second gating integrated circuit receives ripple counter pulses after 2880 clock pulses and switches the logic state at the 50/60-Hz select input; and after 2920 clock pulses the first gating integrated circuit enables a monostable multivibrator connected electrically to the ripple counter, and the first gating integrated circuit acts on the second gating integrated circuit so that the second gating integrated circuit switches the logic state at the 50/60-Hz select input again. A monostable multivibrator can advantageously be connected electrically to the first gating integrated circuit and the ripple counter so that after 2920 clock pulses have been counted by the ripple counter the monostable multivibrator is enabled by the first gating integrated circuit and, at the 2922th clock pulse the monostable multivibrator sends an output pulse to the reset input of the ripple counter to clear the ripple counter. Between the counts 2880 and 2920 the the prescale counter acts as a divide by 50 counter so that it seemingly counts 48 clock pulses. There are therefore 8 additionally counted clock pulses. The digital clock rate has thus been increased by a factor of 2930/2922 and therefore measures sidereal time.

The digital clock portion of the instant invention can be an inexpensive LED digital clock costing from only about $10 and running on 115 volt 60 hz AC and displaying time in a 24 hour format. It must of course have a 50/60 Hz select input. The modifying circuit can be made easily and inexpensively from standard integrated circuits with sockets and vector board. Both the direct current and clock pulses required for the integrated circuits can be obtained from the digital clock portion with a suitable interface. The resulting inexpensive sidereal clock is useful to the back-yard astronomer and will not change its rate when moved outdoors where it is subject to extreme temperature variations.

BRIEF DESCRIPTION OF THE DRAWING FIGURES

THE DETAILED DESCRIPTION OF THE INVENTION

Figure 1:
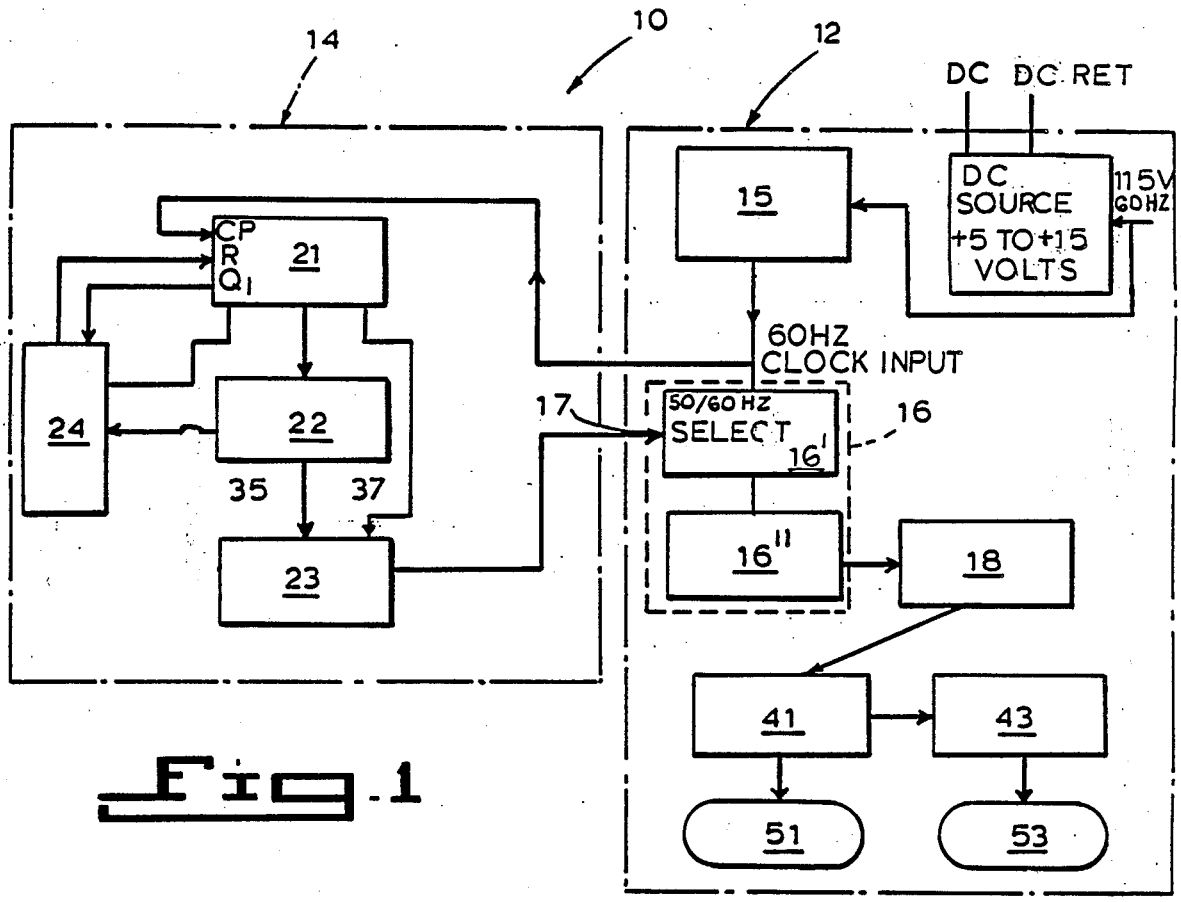
FIG. 1 is a block diagram of a sidereal clock according to the invention showing an inexpensive digital clock portion and an additional modifying circuit which acts to cause the ordinary digital clock portion to run faster at the sidereal rate.

The example of the sidereal clock 10 shown in the drawing has an inexpensive ordinary digital clock portion 12 and an additional modifying circuit 14 coupled to it. The modifying circuit 14 is a means for making the digital clock portion 12 run at the sidereal rate, 2930/2922 times faster than ordinary time.

The ordinary digital clock portion 12 as shown in dot-dashed box in the block diagram of FIG. 1 comprises a prescale counter 16 which is a divide-by-60 device receiving pulses from a 60-Hz pulse source 15 which produces pulses at the rate of the input line AC frequency which of course is 60 Hz in the U.S.A. The prescale counter 16 increments a seconds counter 18 each time it counts 60 pulses. The seconds counter 18 increments a minutes counter 41 when 60 counts are reached in the seconds counter and the hours counter 43 is incremented one hour for every 60 counts in the minutes counter 41. The minutes counter 41 is connected electrically to an LED display 51 and the hours counter 43 is connected to another LED display 53.

The prescale counter 16 comprises on the other hand a divide-by-six-or-five counter 16' and a divide-by-ten counter 16". When the logic state at the 50/60-Hz select input 17 in the divide-by-six-or-five counter 16' is changed(usually to logic one), the divide-by-six-or-five counter divides by five. Then, if 50 Hz AC is input to the digital clock, the prescale counter 16 would still increment the seconds counter 18 once each second of conventional solar time.

The description of the ordinary digital clock portion 12 of the sidereal clock 10 given in the two paragraphs above applies to many currently available inexpensive digital clocks having a 50/60-Hz select input.

The modifying circuit 14 comprises a ripple counter 21, a first gating integrated circuit 22, a second gating integrated circuit 23 and a monostable multivibrator (MV) 24. The input CP of the ripple counter 21 is connected to the output of the 60-Hz pulse source 15 of the clock portion 12 and counts the same clock pulses sent to the prescale counter 16. The ripple counter also outputs ripple counter pulses to both the first gating integrated circuit(IC) 22 and the second gating integrated circuit(IC) 23. The monostable multivibrator 24 receives an enable input from the second gate output 35 of the first gating integrated circuit 22 and on receiving a positive trigger pulse from the ripple counter 21 sends a monostable pulse to the reset input R of the ripple counter 21 which clears all its registers before arrival of the next clock pulse. The time duration of the monostable pulse is controlled by R2 and C2 in FIG. 3. The pulse is long enough to ensure that all registers in the ripple counter 21 are cleared, but not so long that the counter is still held in the reset mode when the next pulse arrives.

The operation of the invention can be understood with reference to the block diagram of the modifying circuit 14. The ripple counter 21 counts clock pulses and then at the 2880th pulse the second gating integrated circuit(IC) 23 outputs a logic pulse changing the logic state at the 50/60-Hz select input 17 so that the divide-by-six-or-five counter 16' now divides by 5. After forty additional clock pulses(after 2920 pulses) have been received from the 60-Hz pulse source 15 the output 37 of the first gating integrated circuit 22 and the output of the second gating integrated circuit 23 connected to the 50/60-Hz select input go to logic zero, i.e. the prescale counter, after the 40 additional clock pulses, again returns to dividing by 60. But during the 40 counts the resident divide by five prescale counter 16' fills up and clears 8 times(40/5 instead of 40/6) and appears to count 48 pulses(If the 50 Hz select had not been switched on, the divide-by-ten counter 16" would have been incremented only 6 times with a count of 4 remaining in the divide-by-6 register. It would have taken two more clocks to increment the divide-by-ten for the 7th time and 6 more for the 8th time). After a count of 2920 pulses in the ripple counter 21 however the output 35 of another gate circuit **22*b* in the first gating integrated circuit 22 goes to logic zero enabling monostable multivibrator 24. When 2922 pulses have been counted, the monostable multivibrator 24 receives a positive trigger pulse from the ripple counter 21 and sends a monostable pulse to the reset input R of the ripple counter 21 to clear all its registers before the next pulse. This completes one operational cycle. Thus although 2922 pulses have been produced from the 60-Hz pulse source 15 the prescale counter has been clocked as if 2930 pulses were received by it so the digital clock portion 12** runs faster by a factor of 2930/2922 which is just the desired increase in rate as described above.

Figure 2:
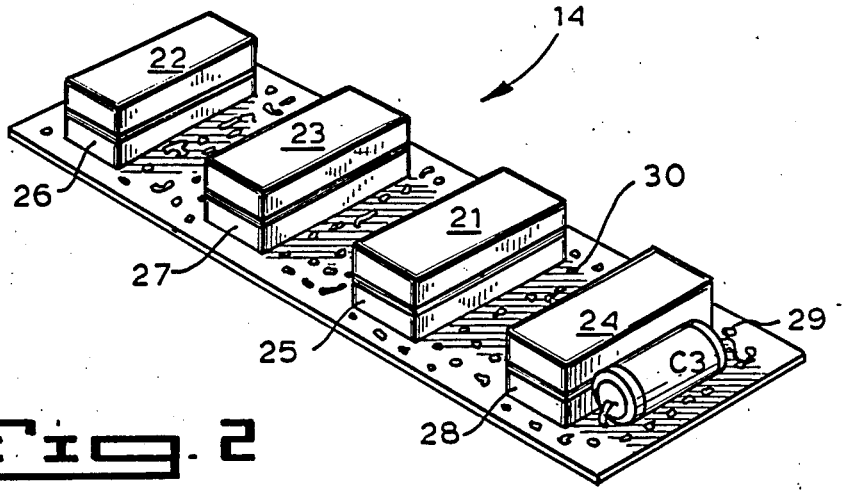
FIG. 2 is a perspective view of an embodiment of the additional modifying circuit which must be connected to the digital clock portion to convert it for sidereal time measurement.

FIG. 2 shows one example of the modifying circuit 14 in a perspective view. The integrated circuits including the ripple counter 21, the monostable multivibrator 24, the first gating integrated circuit 22 and the second gating integrated circuit 23 are mounted in the sockets 25, 28, 26 and 27 respectively which are attached to the vector board 30. Thus the sockets can be attached and wired first as usual to protect the IC components. Also additional capacitors such as C3 and resistors are mounted on this board as well.

Figure 3:
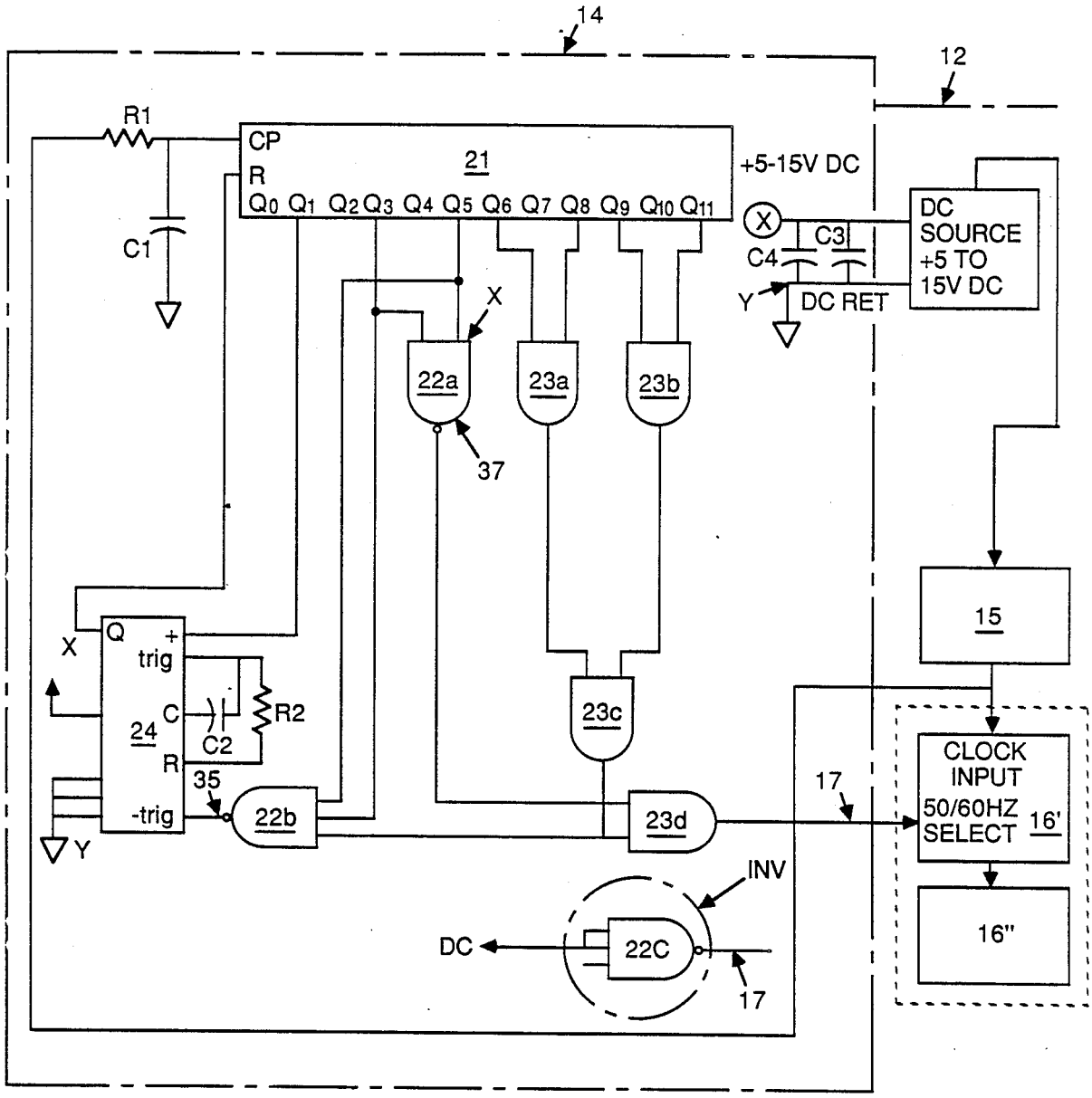
FIG. 3 is a circuit diagram for one example of the additional modifying circuit of FIG. 2.

FIG. 3 shows a specific example of the modifying circuit 14 according to our invention. This circuit is used together with a standard inexpensive commercially available LED digital alarm clock portion 12(Radio Shack Catalog number 63–755 is a typical example) to convert it to a sidereal clock. The ripple counter 21 is a CD4040B integrated circuit. The spare gating circuit **22*c* is separately shown and may be used to invert the output of 23*d* when a clock with a different digital logic is used. The four gating circuits 23*a*, 23*b*, 23*c* and 23*d* of the second gating integrated circuit 23(a CD4081B) are also shown separately. The values of R1 and R2 are 100K-Ohm and 22K 15 ohm respectively. The multivibrator 24 is a CD4047B and the first gating integrated circuit is a CD4023B. The capacitors C1, C2, C3 and C4 are 0.001 Microfarads, 0.1 microfarads, 22 microfarads and 0.01 microfarads respectively. The network of R1 and C1 is employed to protect the ripple counter 21 from excessive line transients. The power circuit PC in the digital clock portion 12 is a positive 5–15 volt direct current output which is filtered with capacitors C3 and C4. Point X in FIG. 3 is connected to 21–16, 22, 23 and 24–14 and point Y is connected to 21–8, 22, 23 and 24–7**.

It will be understood that each of the elements described above, or two or more together, may also find a useful application in other devices differing from the type of device described above.

The invention is not intended to be limited to the details provided above and it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed is new and what is desired to be protected by Letters Patent is set forth in the following claims:

1. A sidereal clock which is powered by 60 Hz alternating current comprising:

a. a digital clock portion that displays time in a 24 hour format, a 60 Hz pulse source, an option for using said digital clock at 50 Hz alternating current, and b. means for electronically switching said option at a periodic rate for the purpose of keeping sidereal time.

2. A sidereal clock in accordance with claim 1 wherein said digital clock portion contains a digital prescale counter having a clock input to receive 60 Hz clock pulses, and a 50/60 Hz select input for controlling the counting of said pulses.

3. A sidereal clock in accordance with claim 2 having said digital prescale counter which is programmable to divide input clock pulses by either 5 or 6 in which said option is exercised at said periodic rate by electronically switching the digital logic state applied to the said 50/60 Hz select input of said digital prescale counter.

4. A sidereal clock in accordance with claim 3 wherein said means for periodically switching said digital logic state at said 50/60 Hz select input comprises a ripple counter electrically connected to said 60 Hz pulse source to count a plurality of clock pulses from said 60 Hz pulse source, and a plurality of decoding gate circuits connected electrically to outputs of said ripple counter to receive a plurality of pulses, and when a pulse count of 2880 has been reached, said decoding gate circuits switch said logic state at said 50/60 Hz select input setting said digital prescale counter to a divide-by-5 mode causing said digital prescale counter to increment 6 times for every 5 pulses received; and when said ripple counter pulse count of 2920 has been reached said decoding gate circuits switch said logic state at said 50/60 Hz select to set said digital prescale counter to a divide-by-6 mode causing said digital prescale counter to increment 1 time for each received pulse.

5. A sidereal clock in accordance with claim 4 further comprising a monostable multivibrator connected to the output of one of said decoding gating circuits from which it receives an enabling pulse at said ripple counter pulse count of 2920 and, when said ripple counter has counted 2922 of said 60 Hz clock pulses it issues a pulse to trigger said monostable multivibrator which, in turn issues an output pulse to the reset input of said ripple counter to clear all its registers, thus restoring its count to zero; and where said output pulse is of sufficiently limited duration so as not to prevent said ripple counter from registering the next received said 60 Hz clock pulse.

6. A sidereal clock in accordance with any one of claims 3 or 4 or 5 claim wherein one operational cycle is comprised of 2922 units of time, and where said operational cycle begins with said digital prescale counter in a divide-by-6 mode, and where said digital logic state is switched after 2880 said units of time to set said digital prescale counter to a divide-by-5 mode, and switched back after 2920 said units of time to set said digital prescale counter to a divide-by-6 mode, and where said unit of time is 1/60 seconds solar time.

7. A sidereal clock in accordance with any one of claims 2 or 3 wherein said digital prescale counter is comprised of two elements:

(a) an input counter programmable to divide input clock pulses by either 5 or 6 and, (b) a decade counter which follows said input counter in cascade thereby resulting in a total digital prescale counter division of said input clock pulses by either 50 or 60.

8. A sidereal clock in accordance with claim 1 wherein said digital clock portion includes said prescale counter, a seconds counter, a minutes counter with displayed output, and an hours counter with displayed output in a 24 hour format.

9. A sidereal clock in accordance with claim 1 wherein said 60 Hz pulse source is derived from the line frequency, and where sufficient residual D.C. power exists to energize said means.

* * * * *